US011731810B2

(12) United States Patent
Tatu et al.

(10) Patent No.: US 11,731,810 B2
(45) Date of Patent: Aug. 22, 2023

(54) INVERTED DISPENSING CONTAINER

(71) Applicant: Colgate-Palmolive Company, New York, NY (US)

(72) Inventors: Francis Tatu, Sea Girt, NJ (US); Brian Balamucki, East Windsor, NJ (US); Mark Bartlett, North East, PA (US); Daniel Peters, Hoboken, NJ (US); Xi Chen, Guangzhou (CN); Shihui Liang, Guangzhou (CN)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 17/194,741

(22) Filed: Mar. 8, 2021

(65) Prior Publication Data

US 2022/0281645 A1 Sep. 8, 2022

(51) Int. Cl.
*B65D 35/10* (2006.01)
*B65D 47/12* (2006.01)

(52) U.S. Cl.
CPC ..... *B65D 35/10* (2013.01); *B65D 47/122* (2013.01)

(58) Field of Classification Search
CPC ..... B65D 35/10; B65D 47/122
USPC ..... 222/212, 213–215, 206, 562; 220/254.2, 220/253, 254.1
See application file for complete search history.

(56) References Cited

U.S. PATENT DOCUMENTS

D139,381 S 11/1944 Harris
D237,049 S 10/1975 Atkins
D263,807 S 4/1982 Kingsford
5,454,486 A * 10/1995 Mack ..... B05B 11/047 222/105
5,996,850 A * 12/1999 Morali ..... B65D 47/128 222/545
6,039,197 A * 3/2000 Braun ..... B65D 47/0861 220/837
D438,785 S 3/2001 Baron
(Continued)

FOREIGN PATENT DOCUMENTS

DE 19824714 4/1999
WO 2008/011966 1/2008
WO 2015/002110 1/2015

OTHER PUBLICATIONS

International Search Report and the Written Opinion of the International Searching Authority issued in International Application PCT/US2022/070829 dated Jun. 29, 2022.

*Primary Examiner* — Lien M Ngo

(57) ABSTRACT

A container for dispensing a composition comprises a container body extending along a longitudinal axis from a bottom end to a top end, the container body defining an internal cavity for holding the composition. The container body comprises a neck having a container opening open to the internal cavity, a front wall, a rear wall and a pair of side walls extending between the front and rear wall, and a shoulder comprising a pair of first shoulder walls extending between the neck and a respective side wall of the container body, the first shoulder walls extending at a first non-perpendicular angle with respect to the longitudinal axis. The container also comprises a shoulder fitting attached to the neck, the shoulder fitting extending over the first and second shoulders of the container body and including a nozzle extending therethrough, the nozzle open to the opening.

19 Claims, 12 Drawing Sheets

(56) References Cited

U.S. PATENT DOCUMENTS

| | | | | |
|---|---|---|---|---|
| 6,305,577 | B1 * | 10/2001 | Fillmore | B05B 11/3069 222/105 |
| D471,820 | S | 3/2003 | Faillant-Dumas | |
| 7,044,333 | B2 * | 5/2006 | Johns | B65D 35/22 222/107 |
| 8,006,709 | B1 | 8/2011 | Ebnayamin | |
| D757,564 | S | 5/2016 | Santos et al. | |
| D790,973 | S | 7/2017 | Kern et al. | |
| D807,182 | S | 1/2018 | Ruthe-Steinsiek | |
| 10,526,113 | B2 * | 1/2020 | Toh | B65D 41/17 |
| D915,890 | S | 4/2021 | Oates | |
| 2013/0254136 | A1 | 9/2013 | Ciavarella et al. | |

* cited by examiner

INVERTED DISPENSING CONTAINER

BACKGROUND

Containers and other types of packaging are known for the retention and exhibition of fluids or gels such as cleaning products, fabric care products, oral care products, etc. Such containers are typically formed with a primary packaging container having a cap attached thereto, the cap having a dispensing opening. To dispense the product from the container, the container is typically squeezed to force a quantity of the product out of the opening. However, in many cases, such dispensing results in a deformation of the container, thus making it more difficult to apply further pressure to dispense additional quantities of the product. Additionally, there is a need for a container that aids in dispensing of all of the product within the dispenser.

BRIEF SUMMARY

The present invention may be directed, in one aspect, to a container designed to hold and/or transfer one or more substances. The container comprises a container body extending along a longitudinal axis from a bottom end to a top end, the container body defining an internal cavity for holding the composition. The container body further comprises a neck having a container opening open to the internal cavity, a front wall, a rear wall and a pair of side walls extending between the front and rear wall and a shoulder comprising a pair of first shoulder walls extending between the neck and a respective side wall of the container body, the first shoulder walls extending at a first non-perpendicular angle with respect to the longitudinal axis. The container further comprises a shoulder fitting attached to the neck, the shoulder fitting extending over the first and second shoulders of the container body and including a nozzle extending therethrough, the nozzle open to the opening.

In an aspect the container may include a cap removably received over the container body, the cap being transparent. The cap may be fitted with a shroud received therein, the shroud having a size and shape complementary to a size and shape of the shoulder fitting. In an aspect, the shroud may be formed of an opaque material so as to be visible through the cap. In an aspect, the shroud of the cap may threadedly engage the shoulder fitting. An end wall of the shroud may abut against the nozzle opening in a closed configuration when the cap is positioned over the container body.

In another aspect, the present invention is directed to a container for dispensing a composition, the container comprising a container body extending along a longitudinal axis from a bottom end to a top end, the container body defining an internal cavity for holding the composition. The container body further comprises a neck having a container opening open to the internal cavity, a front wall, a rear wall and a pair of side walls extending between the front and rear wall, and a shoulder comprising a pair of first shoulder walls extending between the neck and a respective side wall of the container body, the first shoulder walls extending at a first non-perpendicular angle with respect to the longitudinal axis. The container further comprises a shoulder fitting attached to the neck, the shoulder fitting extending over the first and second shoulders of the container body and including a nozzle extending therethrough, the nozzle open to the opening. The container further comprises a cap removably received over the container body and a shroud attached to an inner surface of the cap, the shroud having a size and shape complementary to a size and shape of the shoulder fitting.

In another aspect, the present invention is directed to a container for dispensing a composition, the container comprising a container body extending along a longitudinal axis from a bottom end to a top end, the container body defining an internal cavity for holding the composition. The container body comprises a neck having a container opening open to the internal cavity, a front wall, a rear wall and a pair of side walls extending between the front and rear wall and a shoulder comprising a pair of first shoulder walls extending between the neck and a respective side wall of the container body and a pair of second shoulder walls extending between the neck and a respective one of the front wall and real wall, the first shoulder walls extending at a first non-perpendicular angle with respect to the longitudinal axis, the second shoulder wall forming a second non-perpendicular angle with respect to the longitudinal axis, the second angle being different from the first angle. The container further comprises a shoulder fitting attached to the neck, the shoulder fitting including a nozzle extending therethrough, the nozzle open to the opening, wherein each of the first shoulder walls extends at an angle of 65 degrees with respect to the longitudinal axis wherein the shoulder further comprises a pair of second shoulder walls extending between the neck and a respective one of the front wall and real wall, wherein the second shoulder wall forms a second non-perpendicular angle with respect to the longitudinal axis, the second angle being different from the first angle.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
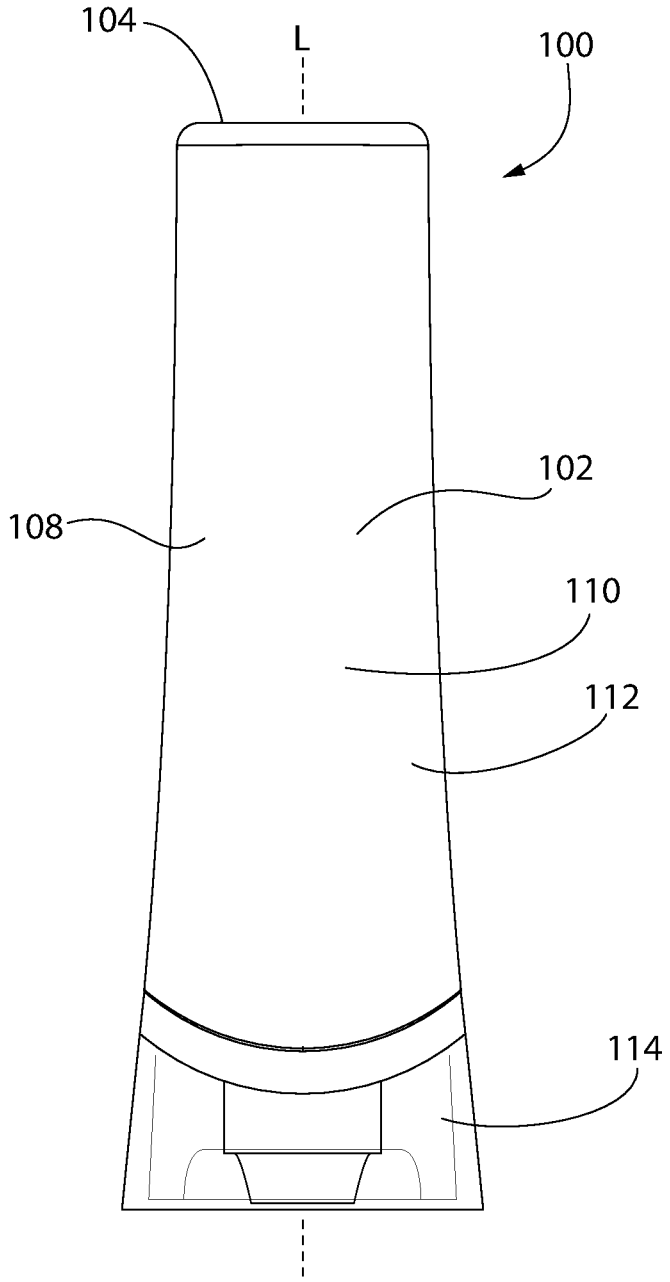
FIG. 1 is a front view of an example container as described herein.
Figure 2:
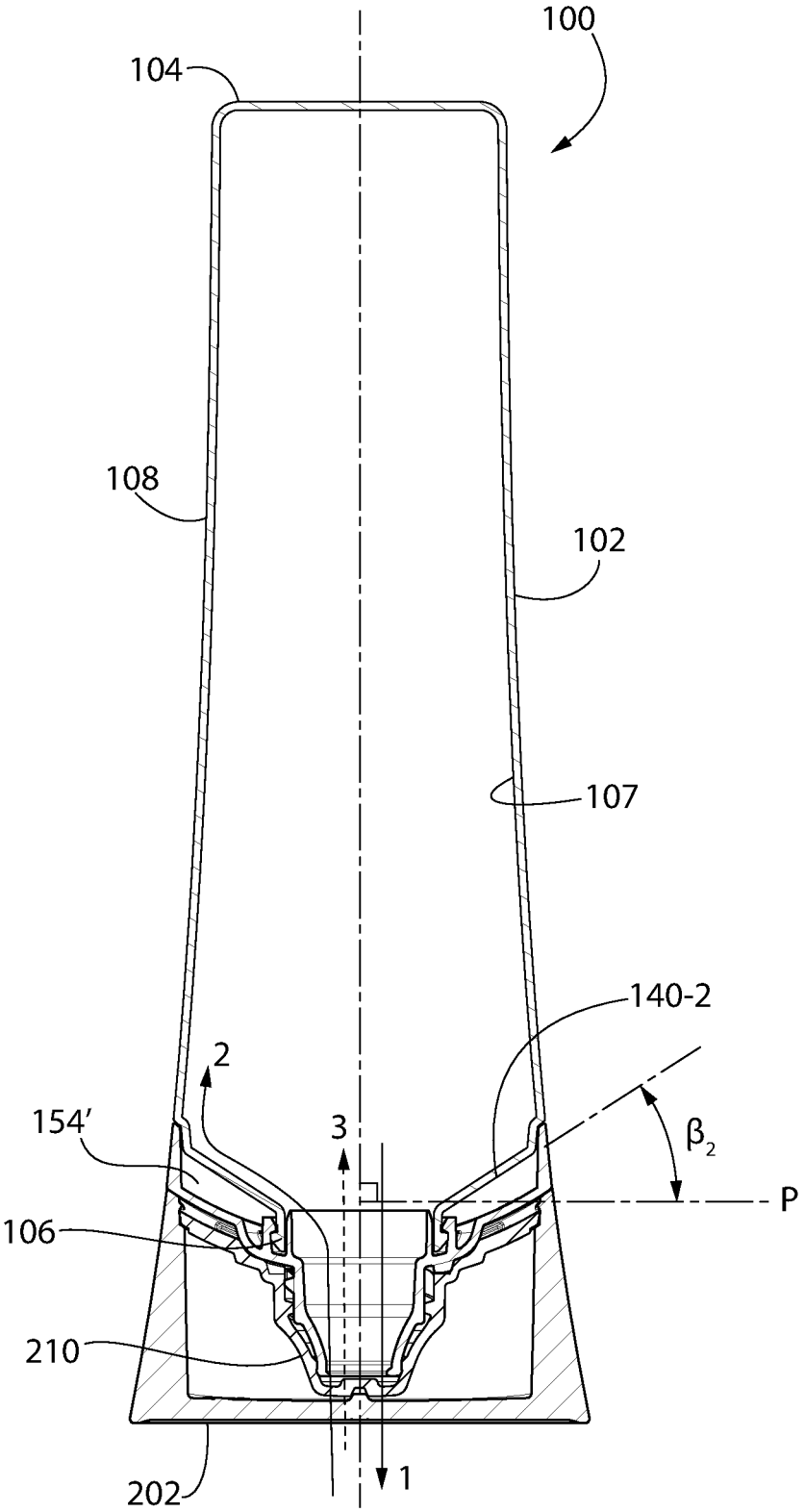
FIG. 2 is a partial cross-section view of the container shown in FIG. 1, taken along line A-A of FIG. 4.
Figure 5:
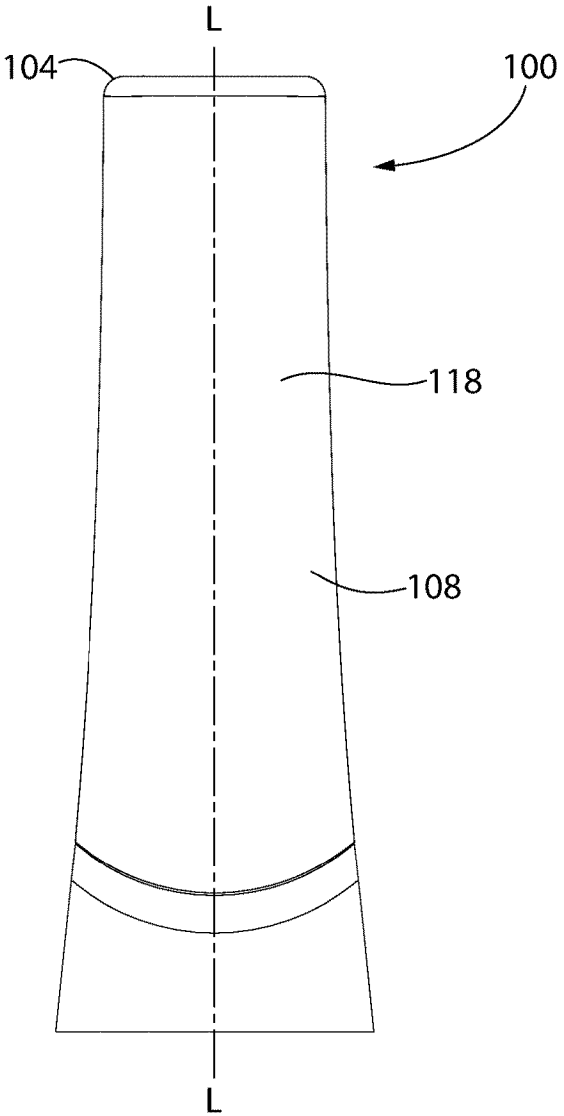
FIG. 5 is a rear view of the container shown in FIG. 1.
Figure 4:
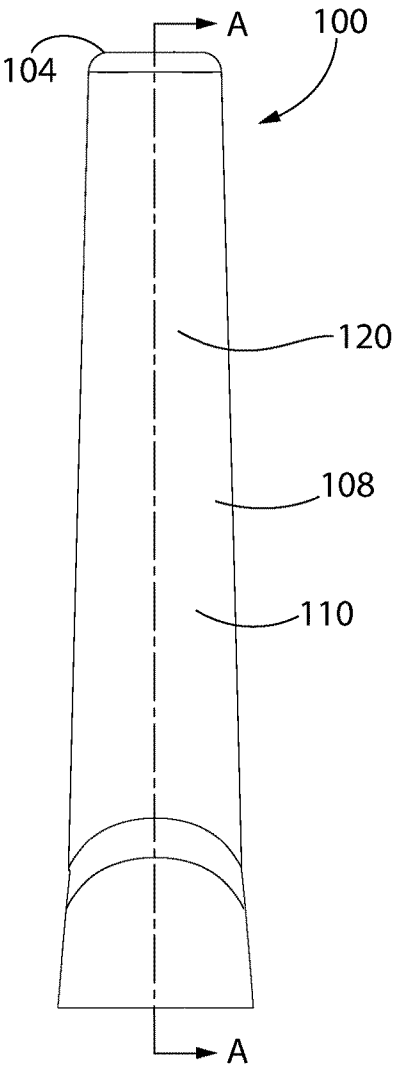
FIG. 4 is a side view of the container shown in FIG. 1.
Figure 3:
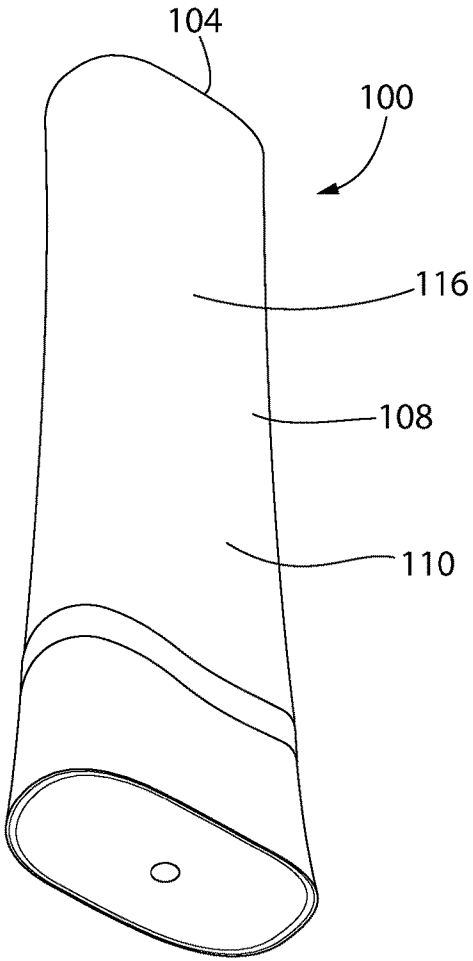
FIG. 3 is a perspective view of the container shown in FIG. 1.

The following description of the preferred embodiments) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical", "above," "below," "up," "down," "top," and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

The proposed container described herein is configured for inverted storage, wherein a cap of the container rests on a table, counter or other flat or substantially flat surface. The container is configured with a geometry selected to aid in a flow of a composition out of the container at a predetermined flow rate. Further, the container and components thereof, including but not limited to, the nozzle dimensions and container shoulder and opening are configured to control the flow rate of the composition out of the container to a predetermined flow rate. This flow rate is selected to permit dispensing of a quantity of the composition while preventing excess flow which can lead to waste or cause a buildup of the composition in the cap. Additionally, the exemplary container minimizes the amount of physical effort required to dispense said quantity of composition. Conventional inverted storage containers seek to address the problem of excess or undesired flow by including a one-way valve or a deflectable membrane completely covering a nozzle opening. However, such containers suffer from the problem of negative air pressure within the container since it is difficult for air to enter the one-way valve or deflectable membrane during or after dispensing. Such containers subsequently deform under the negative internal pressure, leading to destabilization of the container itself and making subsequent dispensing more difficult. That is, during a subsequent use, a user may need to exert a greater amount of compressive force to squeeze the composition out of the container. Furthermore, since air bubble may become trapped in the composition itself, a dispensing force applied to the container may instead force the air bubble out of the container, which may cause the composition to sputter or spray out of the container. The exemplary container described herein is configured so as to guide air in through a dispensing nozzle during and/or after dispensing, wherein the construction of the container guides said air along a path that is not congruent with a flow path of the composition itself, as will be described in greater detail later on. This exemplary configuration also utilizes a nozzle configured to permit flow thereoutof only when a compressive force is applied to the container, thus preventing unwanted leakage thereoutof. Specifically, a nozzle diameter and a length of a channel extending through the nozzle have been selected to ensure that flow remains within a predetermined desirable range. The exemplary nozzle forgoes the need for a membrane or unidirectional valve therein, thus reducing manufacturing cost and time. Still further, the exemplary container described herein is formed with components that are fully recyclable and acceptable into the current recycling stream. Additionally, the exemplary container described herein is configured so as to allow for evacuation of a greater quantity of the product stored therein as compared to standard containers. That is, the exemplary shoulder and nozzle configuration of the container described herein permits the evacuation of a greater quantity of the product so that, when a consumer or other user has finished using the product, there is little to no product remaining in the container. As those of skill in the art will understand, many current containers are configured so that a quantity of product remains trapped in the container (e.g., in the container shoulders, in the nozzle, etc.). Current recycling facilities do not accept containers that have residual product therein. As such, even if a container is formed of recyclable materials, it may be rejected from the recycling stream due to the presence of the residual product. By contrast, the exemplary container described herein is not only formed of recyclable materials, but is also formed with a design which aids in evacuation of all or nearly all of the contents thereoutof so that the container can be accepted into the recycling stream.

Further, whereas conventional containers include a nozzle provided over an opening, the exemplary container 100 described herein comprises a shoulder fitting 154 received over an entirety of an end portion of the container body, including an opening and shoulders thereof. The exemplary shoulder fitting is configured to mate with a respectively formed shroud in a cap to stably seat the container body on the cap in the inverted configuration. By employing a separately formed shoulder fitting, the exemplary container 100 is able to incorporate more intricate features that allow for greater control of the flow path therethrough than with a standard blow-molded bottle. That is, the shoulder fitting is configured for attachment onto the container body after filling of said container body with a desired product, thus allowing for faster filling of the container during a manufacturing step. The exemplary shoulder fitting 154. Further, while a contemporary container may be formed with a nozzle provided over only an opening in the container body, the exemplary shoulder fitting comprises a shoulder fitting that extends over both the opening of the container body as well as the shoulders thereof.

An example container 100 is shown in FIGS. 1-26 and 28. Container 100 may include a container body 102 having a top end 104, a bottom end 106 having an opening 103 formed therein, and a middle portion 108. The middle portion 108 may be located between the top end 104 and the bottom end 106. Container body 102 may extend along a longitudinal axis L from bottom end 104 to top end 106. An outer surface of the container body 102 may include a curved dip or depression at the middle portion 108. Alternatively, the container body 102 may include a linear tapered outer geometry. Container body 102 may define an internal cavity, such as internal cavity 110 housing a store of a product, such as one or more fluidic substances, gels, solids {e.g., powder and/or tablets), gases, combinations of one or more of the substances, or the like. In an embodiment, a product 112 stored in the internal cavity 110 may be an oral care composition having a paste or gel consistency. In other embodiments, the product 112 may be a liquid or solid. A cap 200 may be removably coupled to the container body 102, as will be discussed in greater detail later on.

Figure 6:
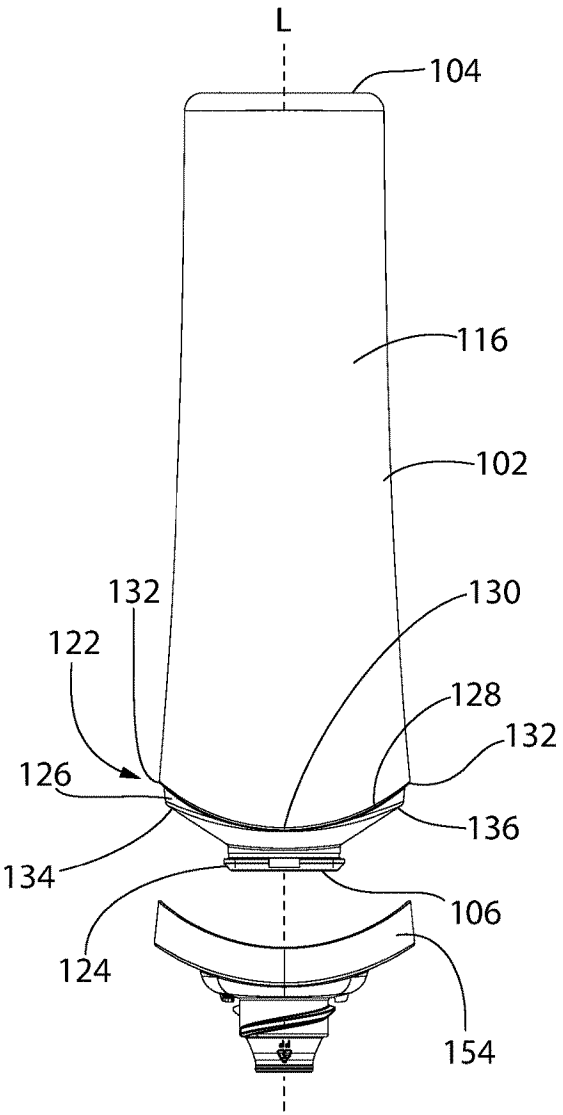
FIG. 6 is a front view of a container body of the container of FIG. 1 in a detached state from a shoulder fitting.
Figure 10:
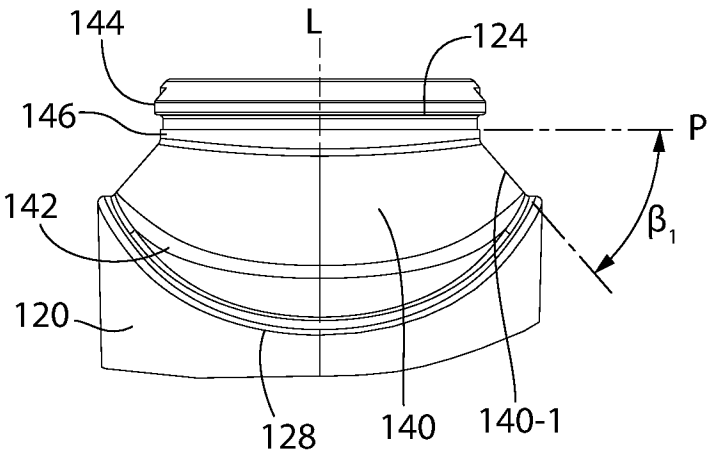
FIG. 10 is a side view of the neck portion of the container body of FIG. 9.

The container body 102 is discussed in greater detail with respect to FIGS. 6-9. The container body 102 comprises an elongated body extending from the top end 104 to the bottom end 106, and having a front surface 116, rear surface 118 and a pair of lateral side surfaces 120 extending between each of the front and rear surfaces 116, 118. The bottom end 106 further comprises a shoulder portion 122 and a reduced diameter neck 124. An outer surface of the shoulder portion 120 is defined by a first curvilinear cutout 126 formed on the front surface 116, an upper edge 128 of the cutout 126 following a U-shaped curvature with an apex or peak 130 aligned with the central longitudinal axis L on each of the front and rear surfaces 116, 118. The upper edge 128 forms valleys 132 along each of the side surfaces 120, wherein each of the two valleys 132 of the upper edge 128 are closer to the top end 104 than the respective peaks 130, only one of which is shown in FIG. 6.

Container 100 (e.g., the container body 102) may be formed of one or more of polyolefins (polypropylenes, low, medium and high density polyethylenes). Container 100 may be formed of one or more of polyethylene terephthalate ("PET") (e.g., made via injection stretch blow molding) and/or elastomeric materials. Container 100 may be formed via one or more combinations of the above. In other examples, container 100 may be formed of one or more other materials.

The shoulder portion 122 further comprises a pair of shoulders 134, 136 which, due to the cutout 126, have a reduced outer profile as compared to the adjacent portion of the container body 102 above the cutout 126. Each of the shoulders 134, 136 comprises a first wall 138 extending in alignment with the longitudinal axis L of the container body 102 and a second wall 140 connected to the first wall 138 along a shoulder edge 142. The shoulder edge 142 may be formed as a beveled surface having a predetermined surface area. The first wall 138 may extend at an angle to the longitudinal axis L of the container body 102. For example, as shown in greater detail in FIG. 9, the first wall 138 may enclose an angle $\alpha$ of between 0 and 45° relative to the longitudinal axis L. As will be discussed in greater detail below, the angle $\alpha$ is selected to ensure a secure fit (e.g. a friction fit) with a shoulder fitting 154 received over the shoulder portion 122. The second wall 140 is formed with a predetermined and precisely calculated angle to control the flow of both the product 112 and air therepast. Specifically, a first portion 140-1 of the second wall 140 located on each of the front surface 116 and rear surface 118 is angled so as to enclose an angle $\beta_1$ with a plane P extending perpendicular to the longitudinal axis L. The angle $\beta_1$ may range from 20-60°, and more specifically from 40-50°, and more specifically 47-50°. Described another way, the first portion 140-1 may be angled at an angle of 65° or approximately 65° with respect to the longitudinal axis L. A portion 140-2 of the second wall extending along the side surfaces 120 encloses an angle $\beta_2$ with the plane P intersecting the longitudinal axis L, the plane P extending parallel to a surface upon which the container 100 rests (i.e., the plane extending parallel to a plane housing a planar surface 202 of the cap 200. That is, the exemplary container 100 has found that an angle $\beta_2$ of 25° provides a flow passageway promoting flow of the product 112 out of the container 100. By contrast, currently available containers are formed with shoulders which extend perpendicular to a longitudinal axis of a container, which results in product being trapped within the container and often requiring the use of excessive force to the container to evacuate the contents thereof. In many cases, such containers are incapable of evacuating all of the contents thereof due to the geometry of the container and, in particular, the geometry of the shoulders. Furthermore, the exemplary angle $\beta_2$ of the invention has been selected to allow for air flow into the container 100 along a desired flow path. That is, with reference to FIG. 2, as product 112 exits the container in direction 1 (i.e., upon application of a compressive force to an outside of the container body 102), air is permitted to enter the container body 102 in direction 2. The angle $\beta_2$ guides air into the container body 102 along a path indicated by directional arrow 2 toward side walls of the container. By contrast, presently available devices guide air into a container in a direction 3 directly into a product housed in the container. When the product is not a liquid, such as in the present case, any air flowing into the container in the direction 3 becomes trapped in the container body as air bubbles. Such air bubbles hinder further dispensing of the product, requiring an excessive force (i.e., a force greater than a force required for an initial dispensing) to dispense further quantities of the product). Furthermore, when the subsequent quantity is dispensed, the trapped air bubble gets pushed back out of the nozzle, thus resulting in a spurting of the product. The exemplary angled shoulder of the container 100 is configured so that any air flowing into the container 100 is guided away from the central longitudinal axis L of the container so that subsequent dispensing results in the same flow rate as the initial dispensing and prevents a sputtering of the product out of the nozzle, thus minimizing/avoiding a wastage of the product, preventing the product from splattering onto unwanted surfaces, and avoiding the need to apply excessive force when dispensing subsequent quantities of the product. Moreover, the exemplary angle $\beta_2$ permits a flow of the product 112 out of the container 100 at a controlled rate, the flow terminating upon release of a compressive force on the outer surface of the container body 102. Specifically, while testing has determined that a shoulder that extends perpendicular to the longitudinal axis of the container 100, it has also determined that simply incorporating a non-perpendicular angle is not sufficient to yield a desired controlled flow rate. For example, an angle $\beta_2$ that is too small (e.g., 15°) is not sufficient to guide air along the desired path B. Similarly, a should angle $\beta_2$ that is too large (e.g., 75°) will result in too great a flow out of the container and hinder flow of air into the container, thus resulting in negative pressure buildup in the container. Preferably, angle $\beta_2$ is 25° when measured with respect to the plane P. The angle $\beta_2$ may alternatively range from 20-90° with respect to the plane P, and more specifically 25-55° with respect to the plane P and, more specifically 25-40 with respect to the plane P. Worded differently, the wall 140-2 may be angled at an angle of 0-70° relative to the longitudinal axis L, and more specifically 35-65° with respect to the longitudinal axis L and, more specifically 50-65° with respect to the longitudinal axis L and, more specifically 65° with respect to the longitudinal axis L. In accordance with the exemplary design, a diameter of the opening 103 may be increased when the angle is reduced and the diameter may be decreased when the angle is increased, so as to provide a controlled rate of flow thereoutof. Alternatively, the diameter of the opening 103 may remain the same.

Figure 8:
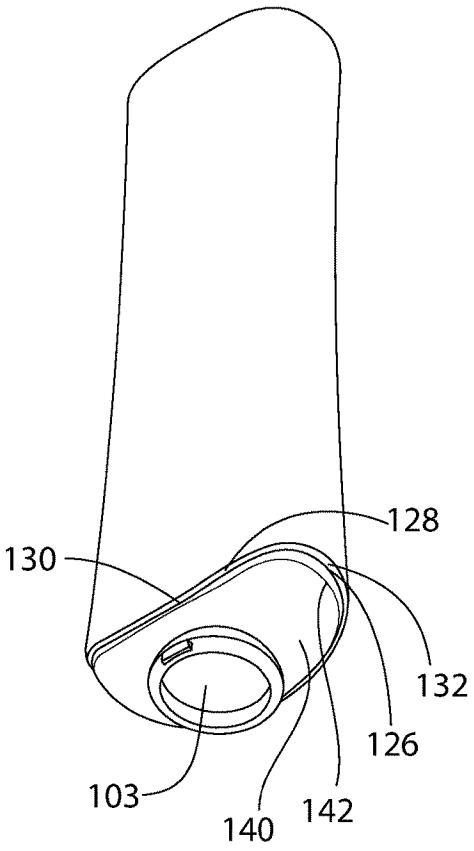
FIG. 8 is a perspective view of the container body of FIG. 7.
Figure 7:
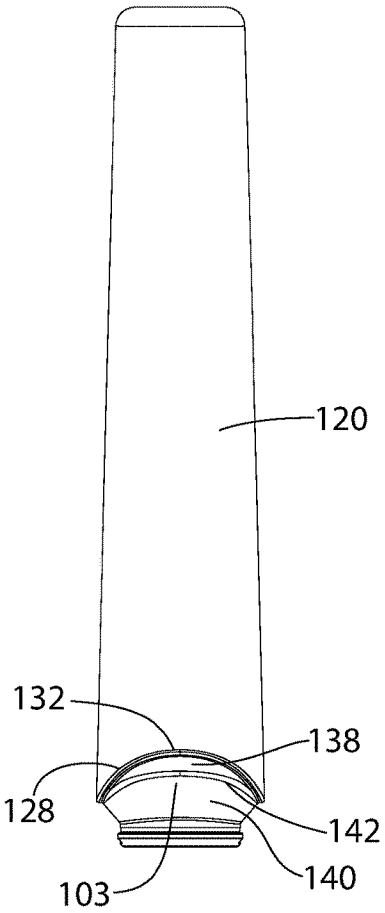
FIG. 7 is a side view of a container body of the container of FIG. 1.
Figure 9:
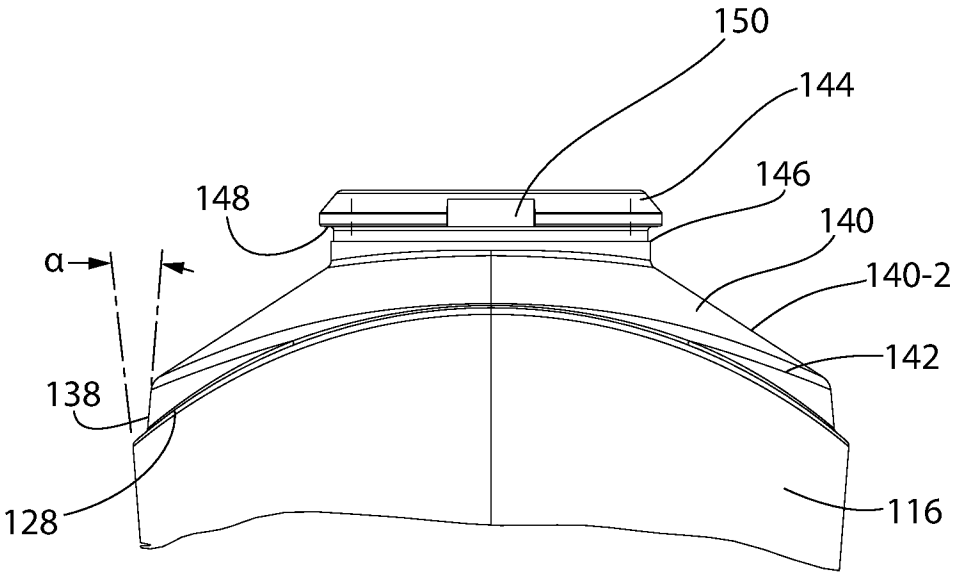
FIG. 9 is a zoomed view of a neck portion of the container body of FIG. 7.
Figure 12:
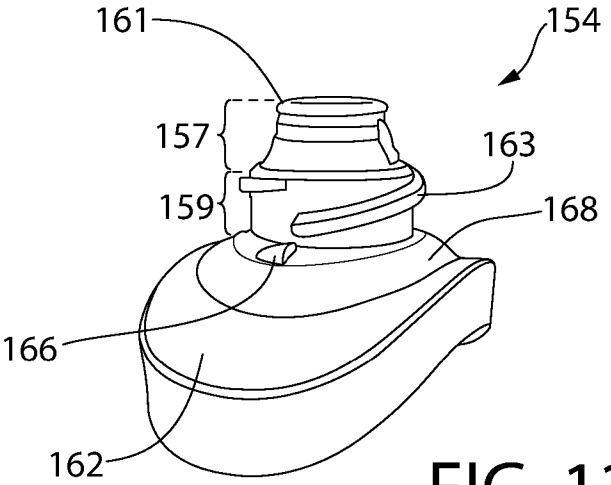
FIG. 12 is a second perspective view of the shoulder fitting of FIG. 11.
Figure 11:
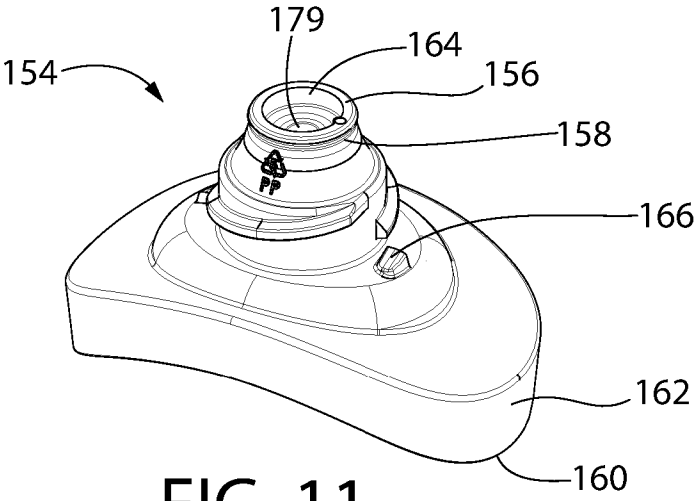
FIG. 11 is a first perspective view of a shoulder fitting of the container of FIG. 1.

The neck 124 of the container body 102 is formed with an upwardly tapered beveled lip 144 extending from an elongated shaft 146, wherein an outer diameter of the tapered beveled lip 144 is greater than an outer diameter of the elongated shaft 146. A planar wall 148 is provided on the tapered beveled lip 144 opposite the bottom end 106, the combination of the tapered beveled lip 144 and planar wall 148 permitting shoulder fitting 154 to be lockingly fitted over the shoulder portion 122. The tapered beveled lip 144 further comprises one or more cutout tab 150 extending at least partially thereinto, the cutout tab 150 allowing for a partial deformation of the lip 144 as the shoulder fitting 154 is slid thereonto. Although one cutout tab 150 is depicted in FIGS. 6, 8 and 9, any plurality of tabs are envisioned (e.g., two tabs 150 separated from one another by 180 degrees across the outer circumference of the lip 144, three tabs 150, each tab 150 separated from an adjacent tab by 120 degrees, four tabs 150, each tab 150 separated from an adjacent tab by 90 degrees, etc.).

The shoulder fitting 154 is configured and adapted to be received over the shoulder portion 122 of the container body 102. The shoulder fitting 154 extends from a first end 156 comprising a nozzle 158 to a second end 160 comprising a base 162. The nozzle 158 comprises an opening 164, which when the shoulder fitting 154 is in position on the container body 102, is open to the product 112 stored therein. A diameter of the opening 164 is selected to permit a predetermined flow rate out of the container 100. That is, extensive testing has been undertaken to determine a nozzle opening diameter which permits flow thereoutof at a desired flow rate while minimizing and/or preventing the buildup of negative pressure within the container 100 as the product 112 is being dispensed, as will be described in greater detail later on. The nozzle 158 comprises a first portion 157 having a substantially conical shape terminating in a slightly enlarged lip 161 and a second portion 159 having a cylindrical shape and having one or more screw threads 163 formed on an outer surface thereof, the screw threads 163 being sized, configured and arranged to engage respectively formed groove(s) 222 formed in the cap 200, as will be discussed in greater detail later on. The shoulder fitting 154 further comprises one or more thread starters 166 configured to aid in alignment of screw threads 163 with respective groove(s) 222 formed in the cap 200.

The base 162 comprises a domed region 168 centered about the longitudinal axis L. An outer surface of the domed region 168 is configured to rest within a respective groove 230 formed in shroud 210 of cap 200, as will be discussed in greater detail later on. An inner surface 169 of the domed region 168 comprises a first circular rib 170 extending in alignment with the longitudinal axis L, a first surface 171 of the first circular rib 170 including a protuberance 172. A circular groove 173 is defined between the first surface 171 of the first circular rib 170 and a second surface 175 of a second circular rib 174, the circular groove 173 receiving the neck 124 of the container body 102 therein. In an operative configuration, the shoulder fitting 154 is positioned in place over the bottom end 106 of the container body 102 and pressed thereonto such that the tapered lip 144 is received within the circular groove 173. During said insertion, engagement of the tapered wall of lip 144 with the protuberance 172 may cause one or both of a radially outward deflection of the first circular rib 170 and a radially inward deflection of the lip 144. Once the tapered lip moves beyond the protuberance 172, engagement of the planar wall 148 with the protuberance 172 lock the shoulder fitting 154 in place over the container body 102.

The base 162 further comprises a band 176, the band 176 having an outer profile substantially matching a cross-sectional shape of the container body 102 such that, when the shoulder fitting 154 is lockingly fitted over the container body 102, the band 176 is seated flush with the outer surface of the container body 102. An inner surface 177 of the band 176 is configure d and dimensioned to come into contact with the first and second walls 138, 140 of the shoulders 134, 136.

Figure 15:
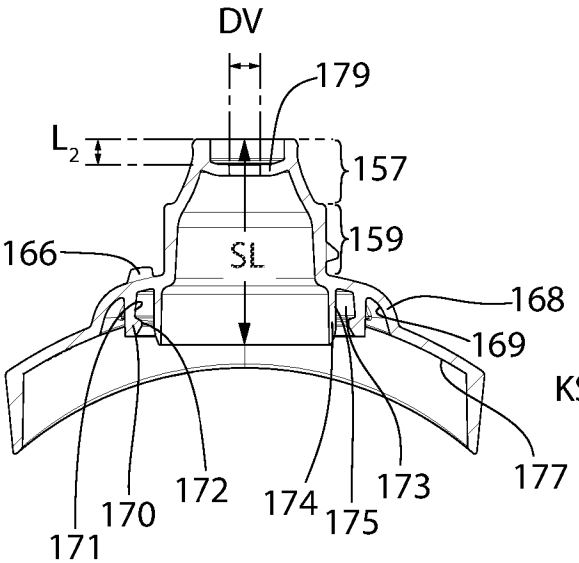
FIG. 15 is a partial cross-sectional view of the shoulder fitting of FIG. 13, taken along axis A-A.
Figure 14:
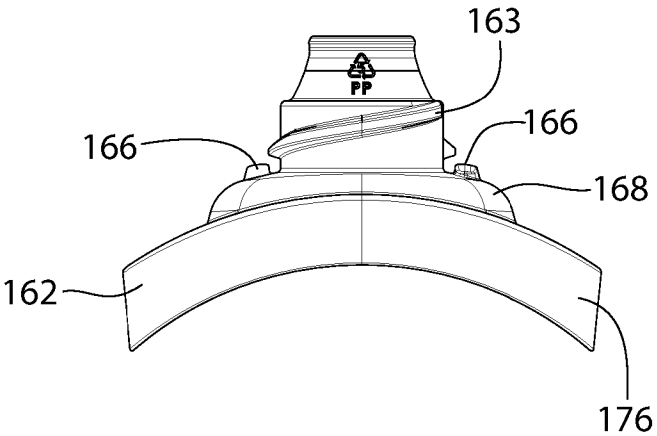
FIG. 14 is a side view of the shoulder fitting of FIG. 11.
Figure 13:
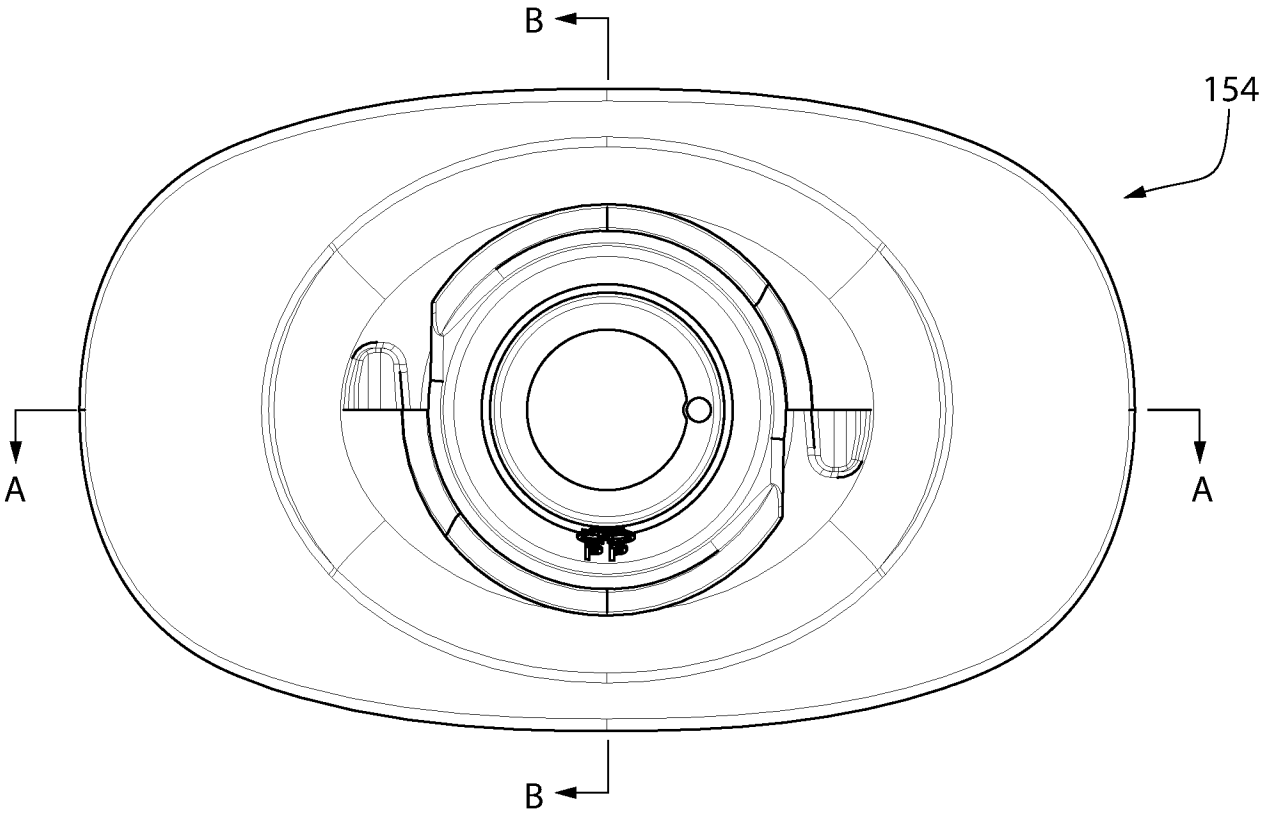
FIG. 13 is a top view of the shoulder fitting of FIG. 11.
Figure 17:
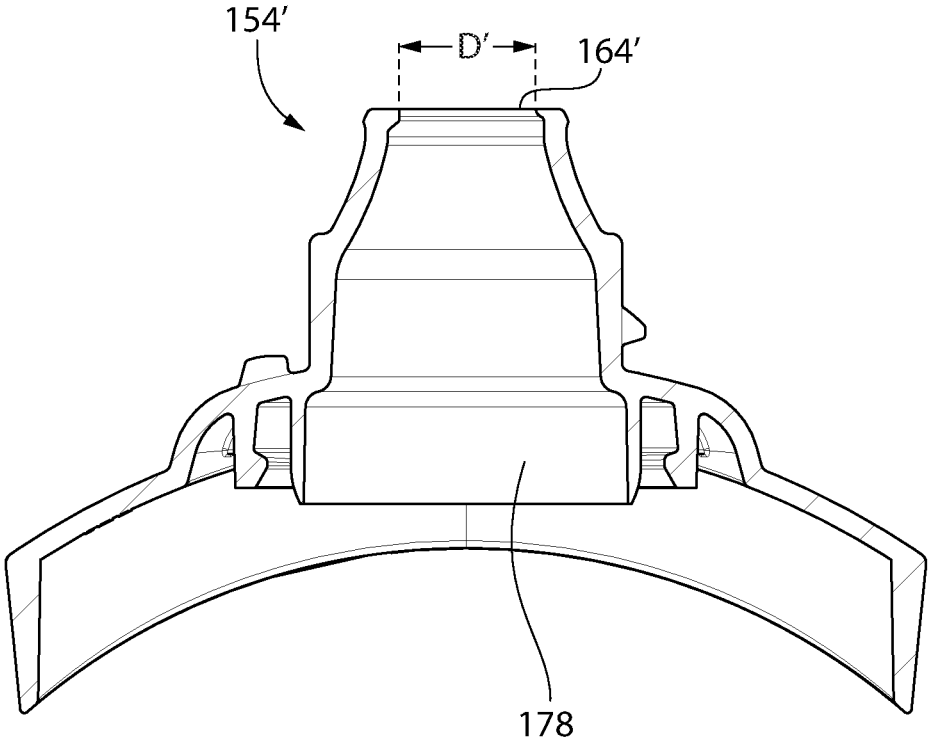
FIG. 17 is a partial cross-sectional view of a shoulder fitting according to another embodiment.
Figure 19:
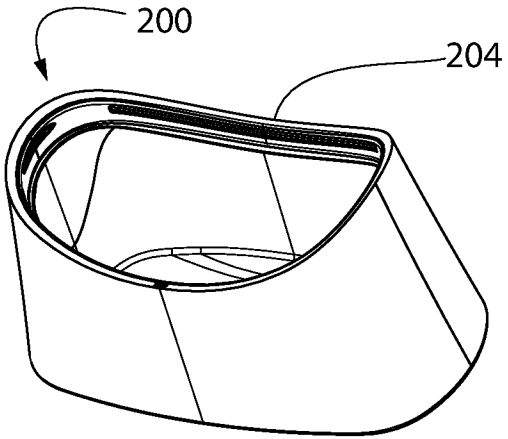
FIG. 19 is a bottom perspective view of the cap of FIG. 18.
Figure 21:
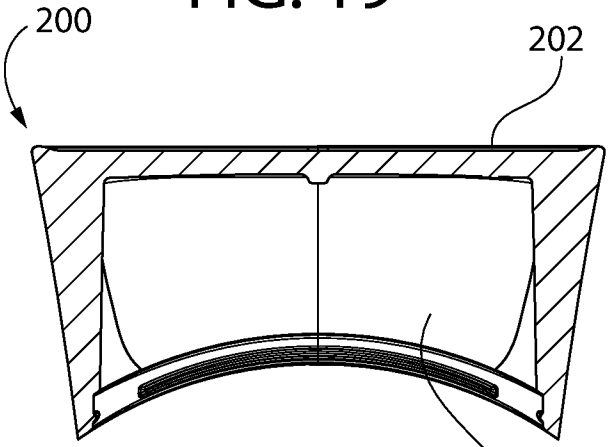
FIG. 21 is a partial cross-sectional view of the cap of FIG. 18, taken along axis C-C of FIG. 20.
Figure 18:
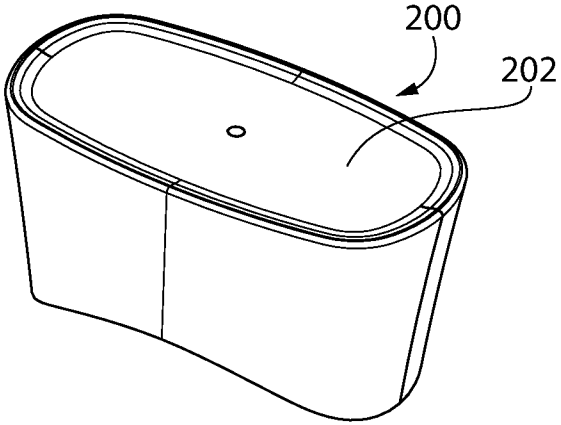
FIG. 18 is a top perspective view of a cap of the container of FIG. 1.
Figure 20:
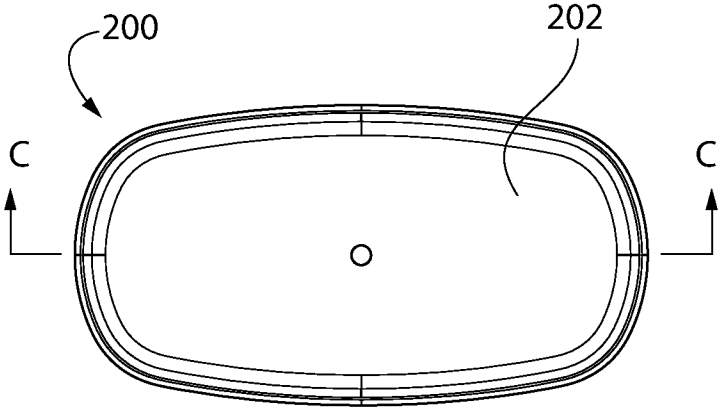
FIG. 20 is a top view of the cap of FIG. 18.
Figure 23:
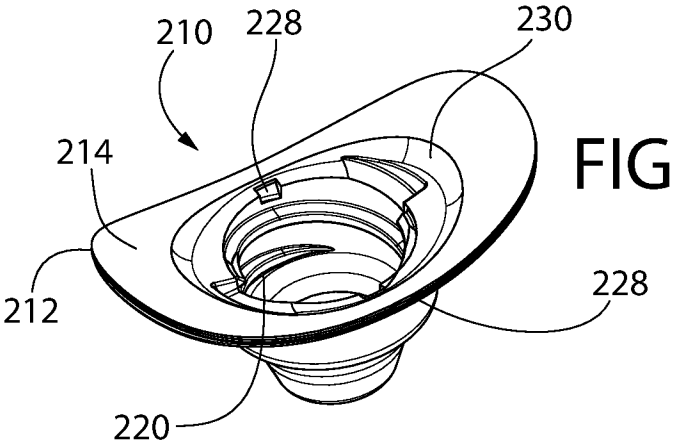
FIG. 23 is a bottom perspective view of the shroud of FIG. 22.
Figure 26:
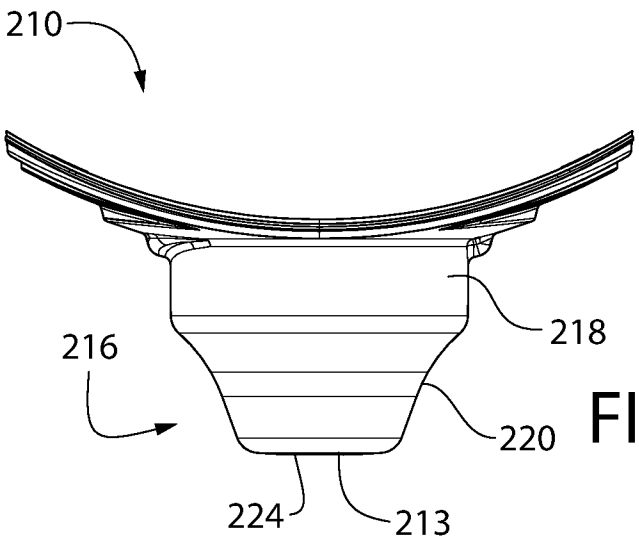
FIG. 26 is a side view of the shroud of FIG. 22.
Figure 22:
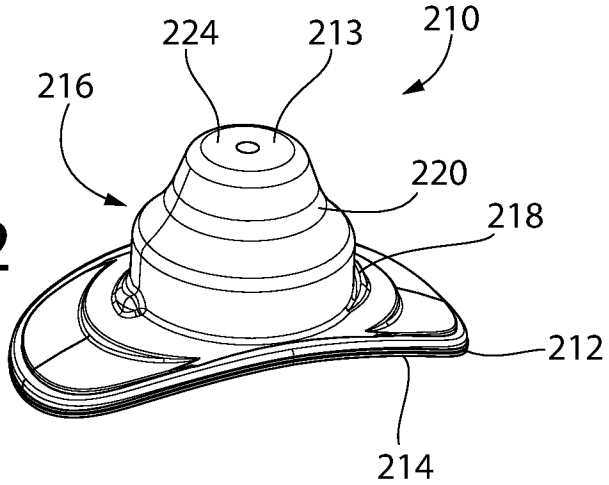
FIG. 22 is a top perspective view of a shroud of the container of FIG. 1.
Figure 25:
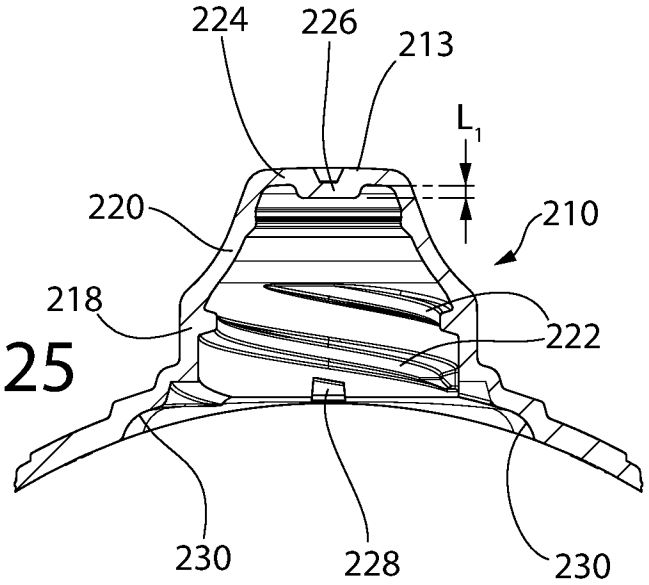
FIG. 25 is a cross-sectional view of the shroud of FIG. 24, taken along the axis D-D.
Figure 24:
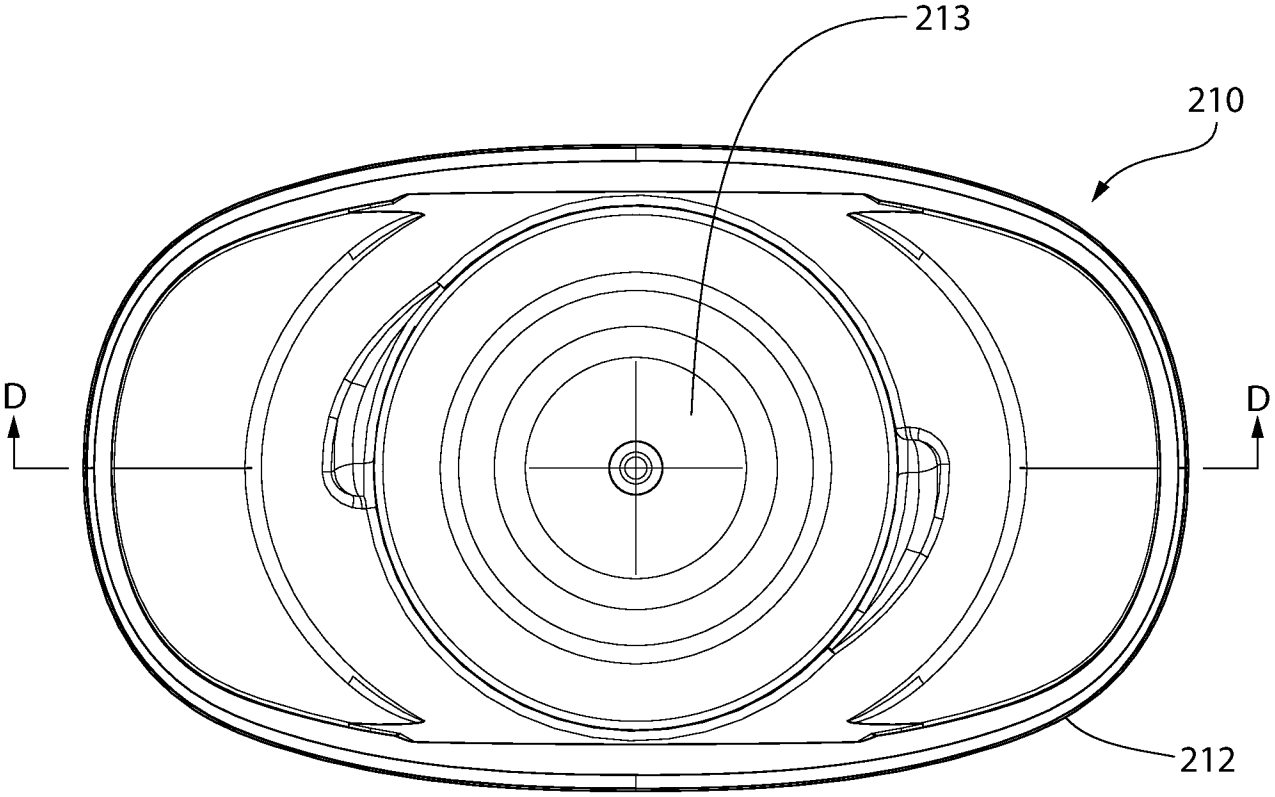
FIG. 24 is a top view of the shroud of FIG. 22.

The opening 164 is open to a channel 178 extending through the shoulder fitting 154. Optionally, the channel 178 may include an orifice restrictor 179 limiting a flow of the product 112 therepast. The orifice restrictor may be formed of any of a silicone, polyethylene or other known material. The orifice restrictor 179 may be formed of the same material as the shoulder fitting 154 or a different material. The orifice restrictor 179 is separated from the opening 164 at the end of the shoulder fitting nozzle 158 by a predetermined distance of 1-5 mm, preferably 2-3 mm. In one example, the orifice restrictor 179 may be separated from the opening 164 by 2.3 mm. The exemplary orifice restrictor 179 is merely a narrowed portion of the channel 178 and permits two-way flow therepast to allow for flow of the product 112 out of the container 100 while also allowing for airflow thereinto to maintain a pressure equilibrium in the container. As will be described in greater detail later on, the construction of the container 100 is specifically formulated so that a one-way valve is not necessary at the nozzle, the container 100 allowing for a predetermined rate of flow thereoutof without the problem of excess flow and/or leakage. The orifice restrictor 179 is separated from the nozzle opening by a minimum non-zero distance $L_2$, as depicted in FIG. 15. For example, the distance $L_2$ may be selected to provide a relief to allow for ease of removal of the shoulder fitting 154 from a mold during a formation process. Specifically, the separation distance $L_2$ allows for some flexing of the nozzle during both manufacturing and use.

Figure 16:
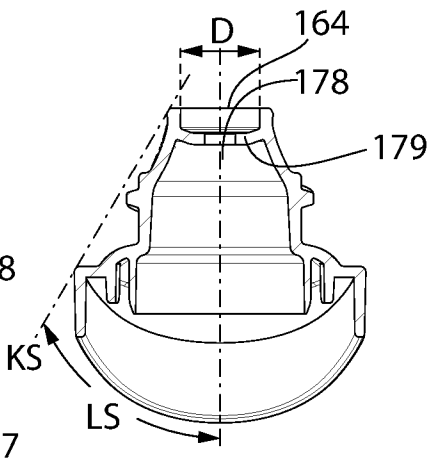
FIG. 16 is a FIG. 14 is a partial cross-sectional view of the shoulder fitting of FIG. 13, taken along axis B-B.

In another embodiment, as depicted in FIG. 16, a shoulder fitting 154' may be formed substantially similar to shoulder fitting 154, with the exception that no orifice restrictor 179 is included in the channel 178. A diameter D' of opening 164' may be smaller than diameter D of opening 164. That is, whereas diameter D may be in the range of 5-10 mm, preferably 7-8 mm, and more preferably 7.2 mm, the diameter D' may be in the range of 5-10 mm, preferably 6-7 mm, and more preferably 6.6 mm. A diameter DV of opening 180 of the orifice restrictor 179 may be approximately 2-3 mm, preferable 2.8 mm.

A spout length SL of the channel 178 of the shoulder fitting 154 is selected to ensure a predetermined flow rate out of the container 100 as well as minimizing entrapment of the product within the nozzle. That is, through extensive testing, it has been determined that a longer spout length SL results in an undesirable effect of the product (i.e., an oral care composition) sticking to the inner surface of the nozzle. For example, a spout length SL of 12.7 mm was determined to be preferable over a spout length SL of 15.3 mm, as will be described hereinafter. For example, various spout lengths ranging from 12.7 mm-21.4 mm have been tested; a spout length of 12.7 mm-18.8 mm is preferable for optimizing flow of the product thereoutof and flow of air thereinto while also providing a good line of sight to a user when dispensing the product 112.

The exemplary nozzle 158 is configured and dimensioned with a preselected inner surface area. The inner surface area of the nozzle 158 is defined as the portion of the inner surface of the nozzle 158 coinciding with channel 178, as depicted for example in FIGS. 15-16. In other words, the inner surface area is the portion of the inner surface of the nozzle 158 that comes into contact with the product 112 as the product 112 is being dispensed. The exemplary nozzle 158 is dimensioned with a length SL and nozzle diameter D selected to yield a desired inner surface area. In a preferred embodiment where the nozzle diameter D is 7.2 mm and the length SL is 12.7 mm, the inner surface area is 468-470 $mm^2$. In an embodiment where an orifice restrictor 179 is provided, the diameter DV may be 2.8 mm and the inner surface area may be 456 $mm^2$. The exemplary nozzle 158 is configured to minimize the spout length SL and increase the nozzle diameter D so as to reduce the volume of product 112 that comes into physical contact with the inner surface of the nozzle, so as to prevent the product 112 from adhering to the inner surface of the nozzle. This configuration foregoes the need to apply a coating (e.g., LiquiGlide, etc.) to the inner surface of the nozzle and instead, facilitates flow of the product 112 past the nozzle. By contrast, present containers are formed with an enlarged inner surface area which often causes a product to become trapped within the nozzle, thus impeding the dispensing of said product. In one example, the nozzle was formed with a smaller diameter D of 6 mm and a longer length SL of 15.3 mm, resulting in an inner surface area of 1426 $mm^2$. However, it was found that this nozzle resulted in a product being trapped within the nozzle or otherwise becoming adhered to the inner surface of the nozzle, thus hindering dispensing of the product or inadvertently causing an excess of the product to be dispensed due to the added compressive pressure required to dispense the product past the nozzle.

Furthermore, taken in combination with the above-noted spout length SL, testing has found that a correlative variation in the diameter D of the opening 164 affects the flow rate. In the present case, testing was performed wherein a diameter D of 6.0 mm was found to yield too low of a flow rate while an increase in diameter D to, for example, 7.2 mm, yields a more desirable flow rate. The preferred flow rate in the exemplary configuration allows for a controlled dispensing of the product 112 from the nozzle 158 while also permitting air to enter the nozzle 158 (i.e., via the opening 164) to prevent a buildup of negative air pressure within the container 100 during and after dispensing.

Additionally, as depicted in FIG. 16, the exemplary nozzle 158 is formed so as to provide a desired line of sight LS aiding in visualization of the product within the nozzle 158 so as to aid in dispensing thereof. Specifically, the line of sight LS defines an angle at which a user orients the container 100 when dispensing the product 112 onto, for example, an oral care implement. The exemplary nozzle diameter D, spout length SL, conically shaped nozzle and width of the band 176 together provide a line of sight LS of 29°, said angle LS enabling a user to view at least a portion of the product 112 as the product exits the opening 164. The line of sight is an angle formed between the longitudinal axis L of the container body and shoulder fitting and a tangential plane TP extending tangentially to the shoulder fitting 154 and intersecting said shoulder fitting at the This exemplary angle aids in dispensing of the product 112 and provides a greater degree of user control of the dispensing as opposed to a container configured with a line of sight which does not enable visualization of the product as it is being dispensed from the container. In an embodiment, the angle LS may be any angle under 30°. For example, the angle LS may be 29° or 17°. It is noted that these values are exemplary only and other values of less than 30° are envisioned within the scope of the invention.

In an exemplary embodiment, the values of the inner surface area SA of the nozzle 158 and nozzle orifice diameter D are selected according to the following ratio R:

$$R = \frac{D}{SA}, \text{ wherein } R \geq 0.0100$$

For example, an exemplary configuration of the invention is detailed below:

$$\frac{D}{SA} = \frac{7.5 \text{ mm}}{735 \text{ mm}^2} = 0.0102$$

In another exemplary configuration, D is 5 mm and SA is 385 $mm^2$, yielding an R value of 0.0129. This configuration yields a preferred flow which aids in guiding air into the nozzle as the product is dispensed thereoutof, while also directing air along the side of the nozzle. It has been determined through testing that a ratio of D/SA which is less than 0.0100 results in air entering the nozzle 158 along a central axis thereof, causing air pockets to consequently travel up the central longitudinal axis L of the container 100 and become trapped in the product 112. By contrast, the exemplary dimensions of the nozzle described above guide air entering the nozzle 158 along an outer periphery of the nozzle orifice, the air pockets being further guided toward the angled second wall 140. As described in greater detail earlier, the second wall 140 guides the air pockets up the side of the container 100. This exemplary configuration allows for the dispensing of a viscous product 112 such as a gel or paste-like composition (i.e., a non-liquid product) without encountering the problem of air pockets becoming entrapped within the product. The skilled person would understand that the gel/paste-like product 112 has a higher viscosity than a liquid such as water which does not encounter the problem of air pockets becoming trapped therewithin as it is being dispensed. The exemplary nozzle and container described herein allows for the dispensing of a higher viscosity product without encountering the problem or air pockets becoming entrapped within the product, which impedes proper dispensing of the product. For example, a nozzle 158 was tested with an inner surface area of 830 $mm^2$ and an orifice diameter D of 6.5 mm.

$$\frac{D}{SA} = \frac{6.5\ \text{mm}}{830\ \text{mm}^2} = 0.0078$$

This configuration was found to result in air traveling up a central axis of the nozzle and container, resulting in air pockets becoming trapped in the product 112 and resulting in an undesirable spurting effect when a viscous product is dispensed.

FIGS. 18-21 depict the cap 200 without a shroud 210 received therein. The cap 200 comprises a planar surface 202 upon which the container 100 rests in an operative configuration. The cap 200 is hollow, having an opening 204 formed therein, the opening 204 sized and shaped to lockingly receive the shroud 210 therein. The cap 200 may be formed of polyethylene and, one embodiment, may be formed of polyethylene terephthalate (PET) having a glossy surface finish. In one example, the cap 200 is transparent, although an opaque material is also envisioned. In the preferred embodiment where the cap 200 is transparent, the shroud 210 is opaque.

The shroud 210 is described in greater detail with respect to FIGS. 22-26. An outer periphery 212 of a first end 214 of the shroud 210 is configured to be seated flush within the cap 200 so that no portion of the shroud 210 extends out of the cap 200, as seen for example in FIG. 2. A nozzle receiving portion 216 of the shroud is configured to seat the first and second portions 157, 159 of the nozzle 158 therein, a shape of the nozzle receiving portion 216 substantially matching the substantially matching the shape of the nozzle 158 (i.e., having a cylindrical component 218 and a substantially conical portion 220). An inner surface of the nozzle receiving portion 216 included one or more threaded grooves 222 configured to threadedly engage screw threads 163.

A second end 213 of the shroud 210 is closed via a wall 224. An inner surface of the wall 224 comprises a job 226, a diameter of which is one of equal to, substantially equal to or smaller than a diameter of the opening 164. In an operative configuration, when the container 100 is in the closed state, the job 226 is housed within the opening 164, thus sealing or plugging the channel 178, prevented any unwanted flow thereoutof when the container 100 is in the closed, inverted configuration. The inner surface of the shroud 216 further comprises at least one groove 228 sized and shaped to receive thread starters 166 therein and a curved groove 230 sized and shaped to receive domed region 168 therein.

Figure 28:
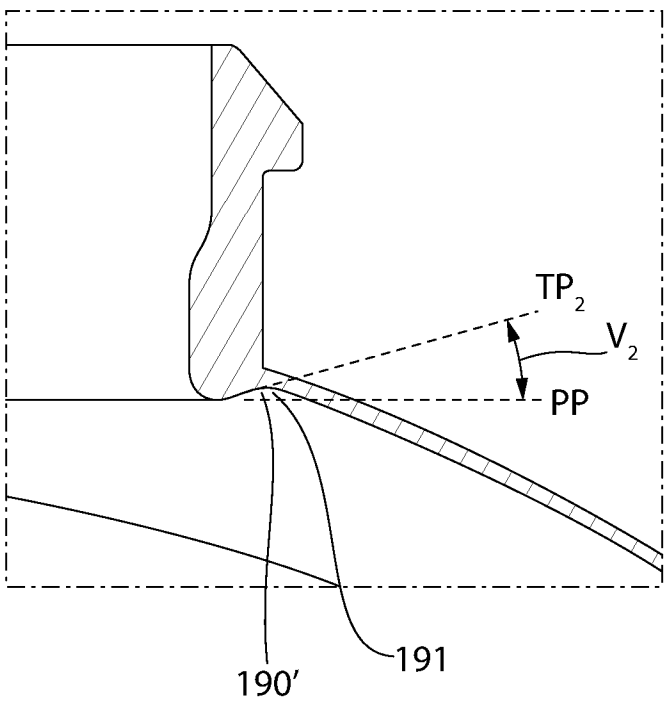
FIG. 28 is a side of neck of another container body.
Figure 27:
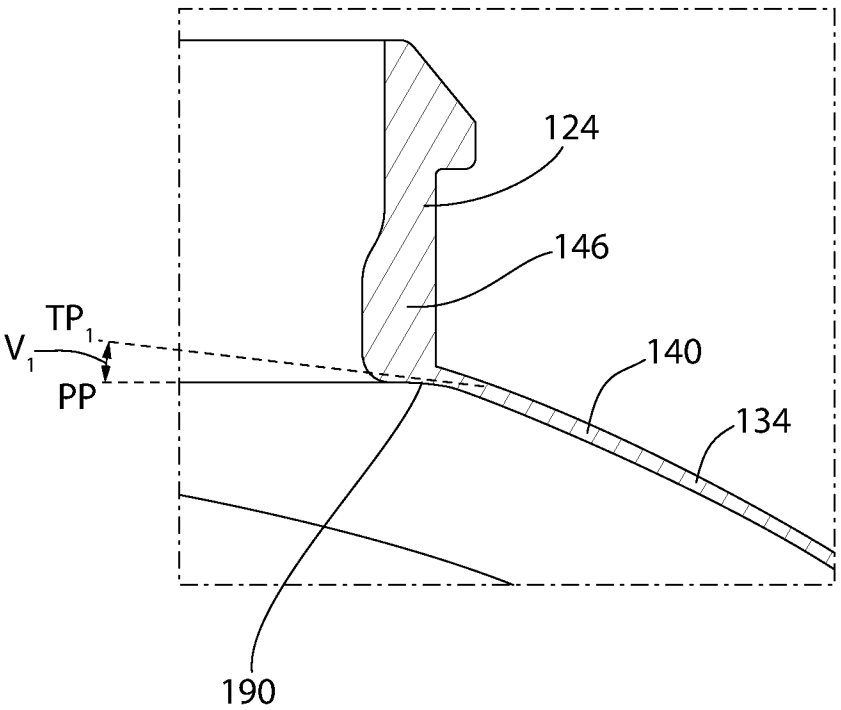
FIG. 27 is a side view of a neck of the container body.

As depicted in FIGS. 27-28, the container body 102 is formed with an exemplary internal geometry designed to provide a transitional wall 190 between the elongated shaft 146 of neck 124 and the second wall 140 of the shoulder 134. The transitional wall 190 is formed so as to minimize protrusion thereof into the internal cavity 110 of the container body 102. That is, the transitional wall 190 is configured such that a first tangential plane $TP_1$ extending tangentially to the transitional wall 190 is substantially aligned with a perpendicular plane PP extending perpendicular to the longitudinal axis and parallel to a surface upon which the container 100 may rest. In this configuration, there is a smooth transition, free of bumps or protrusions, extending between the inner surface of the neck and the inner surface of the shoulder. This configuration prevents the hindrance of product flow therepast. By contrast, FIG. 28 depicts a non-preferred transitional wall 190' having a bump 191 formed thereon, the transitional wall 190' configured such that a second tangential plane $TP_2$ extending tangentially to the transitional wall 190' is not substantially aligned with the perpendicular plane PP. In a preferred embodiment, an angle $\gamma_1$ enclosed between planes $TP_1$ and PP is a negative angle while an angle $\gamma_2$ enclosed between planes $TP_2$ and PP is a positive angle. The transitional wall 190' leads to formation of the bump 191 within the container 102, which inhibits flow of the product 112 out of the container 100 while also altering the path of flow of air into the container. The exemplary container body 102 is formed with a predetermined quantity of materials so that no bumps are formed at the transitional wall 190 during a blow molding process.

During a manufacturing step, the exemplary container body 102 is formed and an inner surface thereof is coated with a predetermined quantity of a coating 107. A coefficient of friction between the product 112 and the coating 107 may be less than a coefficient of friction between the product 112 and an inner surface of the body 102. The coating 107 may prevent the product 112 from sticking to the inner surface of the body 102, thereby allowing the product 112 to slide or slosh or otherwise move around within the internal volume of the body 102 when the user rotates the container 100. In at least one embodiment, the coating 107 may be or include a liquid-impregnated surface, as described in U.S. Pat. No. 8,940,361. For example, the coating 107 may include a matrix of solid features spaced sufficiently close to stably contain a liquid therebetween or therewithin. In at least one embodiment, the coating 107 may be or include LiquiGlide®™ manufactured by LiquiGlide Inc. of Cambridge, Mass. After application of the coating 107, the container body 102 may be filled with the product 112. The shoulder fitting 154 is then positioned over the container body 102 and locked thereto via a snap-fit or friction fit lock. Cap 200 is separately assembled with shroud 210 lockingly received therein. Cap 200 is then threadedly screwed onto the container body 102/shoulder fitting 154 assembly.

The container body 102, shoulder fitting 154, cap 200 and shroud 210 may be formed of one or more of polyolefins (polypropylenes, low, medium and high density polyethylenes), PET, and/or elastomeric materials or one or more combinations of the above. In an embodiment, the cap 200 is formed of a transparent material while the shroud is opaque, such that the shroud 210 is visible through the cap 200. The shoulder fitting 154 may also be opaque, with at least the band 176 being coated with a metallic layer to enhance the appearance of the container 100.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A container for dispensing a composition, the container comprising:

a container body extending along a longitudinal axis from a bottom end to a top end, the container body defining an internal cavity for holding the composition, the container body comprising:

a neck defining an opening to the internal cavity;

a front wall, a rear wall and a pair of side walls extending between the front and rear wall;

a shoulder comprising a pair of first shoulder walls extending between the neck and a respective side wall of the container body;

a shoulder fitting attached to the neck, the shoulder fitting extending over the first shoulder walls of the container body and including a nozzle extending therethrough, the nozzle open to the opening; and a cap removably received over the container body, wherein the cap further comprises a shroud received therein, the shroud engaging the shoulder fitting.

2. The container of claim 1, wherein each of the first shoulder walls extends at an angle of 25 degrees to 65 degrees with respect to the longitudinal axis.

3. The container of claim 1, wherein the shoulder further comprises a pair of second shoulder walls extending between the neck and a respective one of the front wall and real wall, wherein the second shoulder wall forms a second, non-perpendicular angle with respect to the longitudinal axis, the second angle being different from the first angle.

4. The container of claim 1, wherein a channel extends through the nozzle and is open to a nozzle opening, the nozzle opening having a diameter smaller than a diameter of the opening.

5. The container of claim 1, wherein a ratio of a diameter of the nozzle opening to an inner surface area of the channel is greater than or equal to 0.01.

6. The container of claim 5, wherein a length of the channel is 12.7 mm.

7. The container of claim 4, wherein the diameter of the nozzle opening is between 5-10 mm and wherein the inner surface area is 385-470 $mm^2$.

8. The container of claim 7, wherein the diameter of the nozzle opening is 7.5 mm and wherein the inner surface area is 456 $mm^2$.

9. The container of claim 1 wherein the cap is transparent and wherein the shroud has a size and shape complementary to a size and shape of the shoulder fitting.

10. The container of claim 9, wherein the shroud of the cap threadedly engages the shoulder fitting.

11. The container of claim 9, wherein an end wall of the shroud abuts against the nozzle opening in a closed configuration when the cap is positioned over the container body.

12. The container of claim 1, wherein an inner surface of the container body between the neck and shoulder comprises a smooth surface free of protrusions.

13. A container for dispensing a composition, comprising:

a container body extending along a longitudinal axis from a bottom end to a top end, the container body defining an internal cavity for holding the composition, the container body comprising:

a neck having a container opening open to the internal cavity;

a front wall, a rear wall and a pair of side walls extending between the front and rear wall; and a shoulder comprising a pair of first shoulder walls extending between the neck and a respective side wall of the container body, the first shoulder walls extending at a first non-perpendicular angle with respect to the longitudinal axis;

a shoulder fitting attached to the neck, the shoulder fitting extending over the first and second shoulders of the container body and including a nozzle extending therethrough, the nozzle open to the opening;

a cap removably received over the container body; and a shroud attached to an inner surface of the cap, the shroud having a size and shape complementary to a size and shape of the shoulder fitting.

14. The container of claim 13, wherein the cap is transparent and wherein the shroud is opaque.

15. The container of claim 13, wherein each of the first shoulder walls extends at an angle of 65 degrees with respect to the longitudinal axis.

16. The container of claim 13, wherein the shoulder further comprises a pair of second shoulder walls extending between the neck and a respective one of the front wall and real wall, wherein the second shoulder wall forms a second non-perpendicular angle with respect to the longitudinal axis, the second angle being different from the first angle.

17. The container of claim 13, wherein a channel extends through the nozzle and is open to a nozzle opening, the nozzle opening having a diameter smaller than a diameter of the container opening.

18. The container of claim 17, wherein a length of the channel is 12.7 mm, a diameter of the nozzle opening is between 5 and 10 mm and an inner surface area of the channel is 385-470 $mm^2$.

19. The container of claim 13, wherein an end wall of the shroud abuts against the nozzle opening in a closed configuration when the cap is positioned over the container body.

* * * * *